US010820783B2

(12) United States Patent
Lam

(10) Patent No.: US 10,820,783 B2
(45) Date of Patent: Nov. 3, 2020

(54) BRACKET, RACK, AND DISHWASHER

(71) Applicant: ELECTROLUX APPLIANCES AKTIEBOLAG, Stockholm (SE)

(72) Inventor: Cyndia Lam, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 0 days.

(21) Appl. No.: 16/497,958

(22) PCT Filed: Mar. 31, 2017

(86) PCT No.: PCT/EP2017/057761
§ 371 (c)(1),
(2) Date: Sep. 26, 2019

(87) PCT Pub. No.: WO2018/177551
PCT Pub. Date: Oct. 4, 2018

(65) Prior Publication Data

US 2020/0100645 A1 Apr. 2, 2020

(51) Int. Cl.
*A47L 15/50* (2006.01)

(52) U.S. Cl.
CPC ..... *A47L 15/504* (2013.01); *A47L 15/507* (2013.01)

(58) Field of Classification Search
CPC ..... A47L 15/504; A47L 15/507
See application file for complete search history.

(56) References Cited

U.S. PATENT DOCUMENTS

| | | | |
|---|---|---|---|
| 3,472,573 | A | 10/1969 | Geiger |
| 3,486,804 | A | 12/1969 | Kaufman et al. |
| 3,560,069 | A | 2/1971 | Doepke |
| 3,726,580 | A | 4/1973 | Guth |
| 3,726,581 | A | 4/1973 | Doepke |
| 3,734,589 | A | 5/1973 | Morgan |
| 3,736,037 | A | 5/1973 | Doepke |

(Continued)

FOREIGN PATENT DOCUMENTS

| | | | |
|---|---|---|---|
| CH | 690488 | A5 | 9/2000 |
| CN | 201 905 852 | U | 7/2011 |

(Continued)

OTHER PUBLICATIONS

International Search Report and Written Opinion for PCT/EP2017/057761 dated Dec. 18, 2017, 10 pages.

*Primary Examiner* — Hanh V Tran
(74) *Attorney, Agent, or Firm* — Alston & Bird LLP

(57) ABSTRACT

A bracket is disclosed that may be configured to hold a rack of a dishwasher against a wall of a washing chamber of the dishwasher. The bracket may include a first bracket member comprising a first fastening element configured to fasten the first bracket member to a first mounting portion of the rack. The bracket may further include a second bracket member slidably arranged to the first bracket member along a first direction. The second bracket member may include a second fastening element configured to fasten the second bracket member to a second mounting portion of the rack upon a sliding movement of the second bracket member in the first direction. The present disclosure further relates to a rack comprising a bracket and a dishwasher comprising a rack.

14 Claims, 4 Drawing Sheets

(56) References Cited

U.S. PATENT DOCUMENTS

| | | | | |
|---|---|---|---|---|
| 3,744,646 | A | 7/1973 | Duncan et al. | |
| 3,809,451 | A | 5/1974 | Pitstick | |
| 3,822,085 | A | 7/1974 | Clark | |
| 4,064,887 | A | 12/1977 | Geiger et al. | |
| 4,097,099 | A | 6/1978 | Spiegel | |
| 5,474,378 | A | 12/1995 | Smith et al. | |
| 5,595,200 | A | 1/1997 | Favaro | |
| 5,657,878 | A | 8/1997 | Austin | |
| 5,860,716 | A | 1/1999 | Good et al. | |
| 6,755,490 | B2 | 6/2004 | Welch et al. | |
| 6,974,040 | B2 | 12/2005 | Jahrling | |
| 7,032,604 | B2 | 4/2006 | Welch | |
| 7,168,578 | B2 | 1/2007 | Mersch et al. | |
| 7,410,228 | B2 | 8/2008 | Dickson et al. | |
| 7,775,378 | B2 * | 8/2010 | Tynes | A47L 15/504 211/41.8 |
| 8,192,557 | B2 * | 6/2012 | Ryu | A47L 15/504 134/147 |
| 8,534,471 | B2 * | 9/2013 | Wong | A47L 15/504 211/41.8 |
| 8,840,201 | B2 * | 9/2014 | Garnett | A47L 15/504 312/228.1 |
| 9,763,557 | B2 * | 9/2017 | Kim | A47L 15/504 |
| 10,022,037 | B2 * | 7/2018 | Kutto | A47L 15/507 |
| 10,051,963 | B2 * | 8/2018 | Azkue | A47B 46/005 |
| 10,136,795 | B2 * | 11/2018 | Nowell, Jr. | A47L 15/507 |
| 2004/0103932 | A1 | 6/2004 | Kim | |
| 2005/0001524 | A1 | 1/2005 | Deiss et al. | |
| 2005/0039782 | A1 | 2/2005 | Kim | |
| 2005/0133469 | A1 | 6/2005 | Mersch et al. | |
| 2006/0119236 | A1 | 6/2006 | Dickson et al. | |
| 2006/0237042 | A1 | 10/2006 | Weaver et al. | |
| 2008/0272072 | A1 | 11/2008 | Tynes et al. | |
| 2011/0018410 | A1 * | 1/2011 | Bastuji | A47L 15/504 312/228.1 |
| 2013/0247944 | A1 * | 9/2013 | Fischer | A47L 15/50 134/164 |
| 2015/0305493 | A1 * | 10/2015 | Garcia | A47B 46/005 211/86.01 |
| 2016/0331204 | A1 * | 11/2016 | Kutto | A47L 15/504 |
| 2017/0265713 | A1 * | 9/2017 | Kopyrin | A47L 15/504 |

FOREIGN PATENT DOCUMENTS

| | | | |
|---|---|---|---|
| CN | 205 197 927 | U | 5/2016 |
| DE | 3025311 | A1 | 1/1982 |
| DE | 4227585 | A1 | 2/1994 |
| DE | 4401259 | A1 | 7/1995 |
| DE | 19512128 | A1 | 10/1996 |
| DE | 19954471 | A1 | 5/2001 |
| DE | 10 2010 031165 | A1 | 1/2012 |
| EP | 0033483 | A2 | 8/1981 |
| EP | 0372342 | A1 | 6/1990 |
| EP | 0788763 | A2 | 8/1997 |
| EP | 848930 | A2 | 6/1998 |
| EP | 0901770 | A2 | 3/1999 |
| EP | 1051944 | A1 | 11/2000 |
| EP | 1136030 | A1 | 9/2001 |
| EP | 1161917 | A2 | 12/2001 |
| EP | 1166708 | A2 | 1/2002 |
| EP | 1208791 | A1 | 5/2002 |
| WO | WO 0249495 | A1 | 6/2002 |
| WO | WO 2006/116384 | A1 | 11/2006 |
| WO | WO 2009/083402 | A1 | 7/2009 |

* cited by examiner

BRACKET, RACK, AND DISHWASHER

CROSS-REFERENCE TO RELATED APPLICATIONS

This application is a national stage application filed under 35 U.S.C. § 371 of International Application No. PCT/EP2017/057761 filed Mar. 31, 2017 and published as WO2018177551, which application is hereby incorporated by reference herein in its entirety.

TECHNICAL FIELD

The present disclosure relates to a bracket configured to hold a rack of a dishwasher against a wall of a washing chamber of the dishwasher. The present disclosure further relates to a rack comprising a bracket and a dishwasher comprising a rack.

BACKGROUND

A dishwasher is an apparatus for washing items using a force of washing liquid sprayed onto the items within a washing chamber of the dishwasher. The items, such as dishware and cutlery, are positioned in one or more racks within the washing chamber. Usually, such racks are mounted onto side walls of the washing chamber, using components such as rails and brackets which are fastened using fastening elements such as screws, nuts, bolts, snap fasteners, etc. Also, most dishwashers comprise mounting arrangements which allows the rack to be extracted out of the washing chamber to facilitate access to the rack.

The mounting of racks onto side walls of a washing chamber is a time-consuming task, partly due to the limited space available inside the washing chamber, especially when a rack is inserted therein, and since an assembler usually has to reach into portions inside the washing chamber to fasten components thereto. Today's consumer market requires high quality products which can be manufactured in a cost-efficient manner. When manufacturing apparatuses such as dishwashers, the cost for the assembly of the apparatus constitutes a significant part of the final cost of the product.

In view of the above, there is a need for a facilitated assembly of components of a dishwasher.

SUMMARY

It is an object of the present invention to provide conditions for a facilitated assembly of components of a dishwasher.

According to a first aspect of the invention, the object is achieved by a bracket configured to hold a rack of a dishwasher against a wall of a washing chamber of the dishwasher. The bracket comprises a first bracket member comprising a first fastening element configured to fasten the first bracket member to a first mounting portion of the rack. The bracket further comprises a second bracket member slidably arranged to the first bracket member along a first direction. The second bracket member comprises a second fastening element configured to fasten the second bracket member to a second mounting portion of the rack upon a sliding movement of the second bracket member in the first direction.

Thereby, a bracket is provided which a user may fasten onto a rack simply by fasten the first bracket member to a first mounting portion of the rack, using the first fastening element, and then fasten the second bracket member to the second mounting portion of the rack by performing a sliding movement of the second bracket member in the first direction. In this manner, the bracket can be fastened onto the rack in a simple, quick and cost-effective manner.

As a result, a bracket is provided facilitating mounting thereof onto a rack. Thus, conditions are provided for a facilitated assembly of components of a dishwasher. Accordingly, the above-mentioned object is achieved.

Further, since conditions are provided for a facilitated assembly of components of a dishwasher, conditions are provided for a cost-efficient assembly a dishwasher, comprising the rack and the bracket.

Optionally, the second fastening element comprises a hook with an open portion facing in the first direction. Thereby, a quick and simple fastening of the second bracket member to the second mounting portion of the rack is ensured. Further, when fastened, a secure mounting is provided of the second fastening element to the second mounting portion, and thus also a secure mounting of the bracket to the rack.

Optionally, the bracket comprises a guiding structure configured to prevent movement of the second bracket member relative the first bracket member in directions differing from the first direction and a second direction, wherein the second direction is opposite to the first direction. Thereby, a rigid bracket is provided and separation of the first and second bracket members is avoided when the bracket is mounted onto the rack, as well as prior to when the bracket is mounted onto the rack. As results thereof, a secure mounting of the rack against a wall of the dishwasher is provided and handling of the bracket is facilitated prior to the mounting the bracket to the rack, as well as during the mounting of the bracket to the rack.

Optionally, the guiding structure is further configured to prevent sliding movement of the second bracket member in the second direction past a predetermined position relative the first bracket member. Thereby, separation between the first and second bracket members is further avoided and handling of the bracket is facilitated prior to the mounting the bracket to the rack, as well as during the mounting of the bracket to the rack.

Optionally, the guiding structure comprises a slot arranged in one bracket member of the first and second bracket members, and a guiding element protruding into the slot, wherein the guiding element is arranged at the other bracket member of the first and second bracket members than the bracket member comprising the slot. Thereby, movement of the second bracket member relative the first bracket member in directions differing from the first direction and a second direction is avoided in a simple and efficient manner.

Optionally, the first and second bracket members abut against each other in a respective abutting surface, wherein the guiding element extends through the slot, and wherein the guiding element comprises one or more guiding surfaces abutting against a surface being opposite to the abutting surface of the bracket member comprising the slot. Thereby, movement of the second bracket member relative the first bracket member in directions differing from the first direction and the second direction is further avoided in a simple and efficient manner. In addition, separation of the first and second bracket members is further avoided.

Optionally, at least one bracket member of the first and second bracket members comprises wheels configured to allow horizontal displacement of the rack in relation to the wall of the washing chamber. Thereby, a bracket is provided capable of allowing horizontal displacement of the rack relative a wall of a washing chamber when positioned therein, while it can be fastened onto the rack in a simple and efficient manner.

According to a second aspect of the invention, the object is achieved by a rack comprising a bracket according to some embodiments of above. Since rack comprises a bracket facilitating mounting thereof onto the rack, conditions are provided for a facilitated assembly of components of a dishwasher.

As a result, the above-mentioned object is achieved.

Optionally, the first mounting portion is a portion of a wire of the rack. Thereby, a simple and effective fastening of the first bracket member to the first mounting portion of the rack can be provided, using the first fastening element.

Optionally, the second mounting portion is a portion of a wire of the rack. Thereby, a simple and effective fastening of the second bracket member to the second mounting portion of the rack can be provided using the second fastening element.

Optionally, the first direction is essentially perpendicular to a direction of extension of the wire. Thereby, a simple and effective fastening of the second bracket member to the second mounting portion of the rack is provided upon the sliding movement of the second bracket member in the first direction.

Optionally, the first fastening element and the first mounting portion are arranged to allow pivotal movement of the bracket relative the first mounting portion when the second fastening element is released from the second mounting portion. Thereby, the fastening of the first fastening element to the first mounting portion is facilitated since the fastening can be performed at various angles of the first bracket member relative the rack. When the first fastening element has been fastened to the first mounting portion, the bracket can, due to these features, be pivoted into an angle allowing fastening of the second fastening element to the second mounting portion of the rack. Accordingly, since the first fastening element and the first mounting portion are arranged to allow pivotal movement of the bracket relative the first mounting portion, the mounting of the bracket to the rack is further facilitated.

Optionally, the first and second fastening elements are configured to allow displacement of the bracket relative the rack in vertical directions thereof to provide at least two different vertical positions of the rack within the washing chamber. Thereby, a rack is provided comprising a bracket capable of allowing displacement of the bracket relative the rack in vertical directions thereof to provide at least two different vertical positions of the rack within the washing chamber, in which the bracket can be fastened onto the rack in a simple and efficient manner.

Optionally, the at least two different vertical positions comprise an upper position and a lower position, wherein the bracket comprises a retaining element configured to retain the rack in the upper position upon displacement of the rack to the upper position. Thereby, a user-friendly rack is provided in which the bracket can be fastened onto the rack in a simple and efficient manner.

According to a third aspect of the invention, the object is achieved by a dishwasher comprising a rack according to some embodiments of above. Since the dishwasher comprises a rack comprising a bracket which facilitates mounting thereof onto the rack, conditions are provided for a facilitated assembly of components of the dishwasher.

As a result, the above-mentioned object is achieved.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
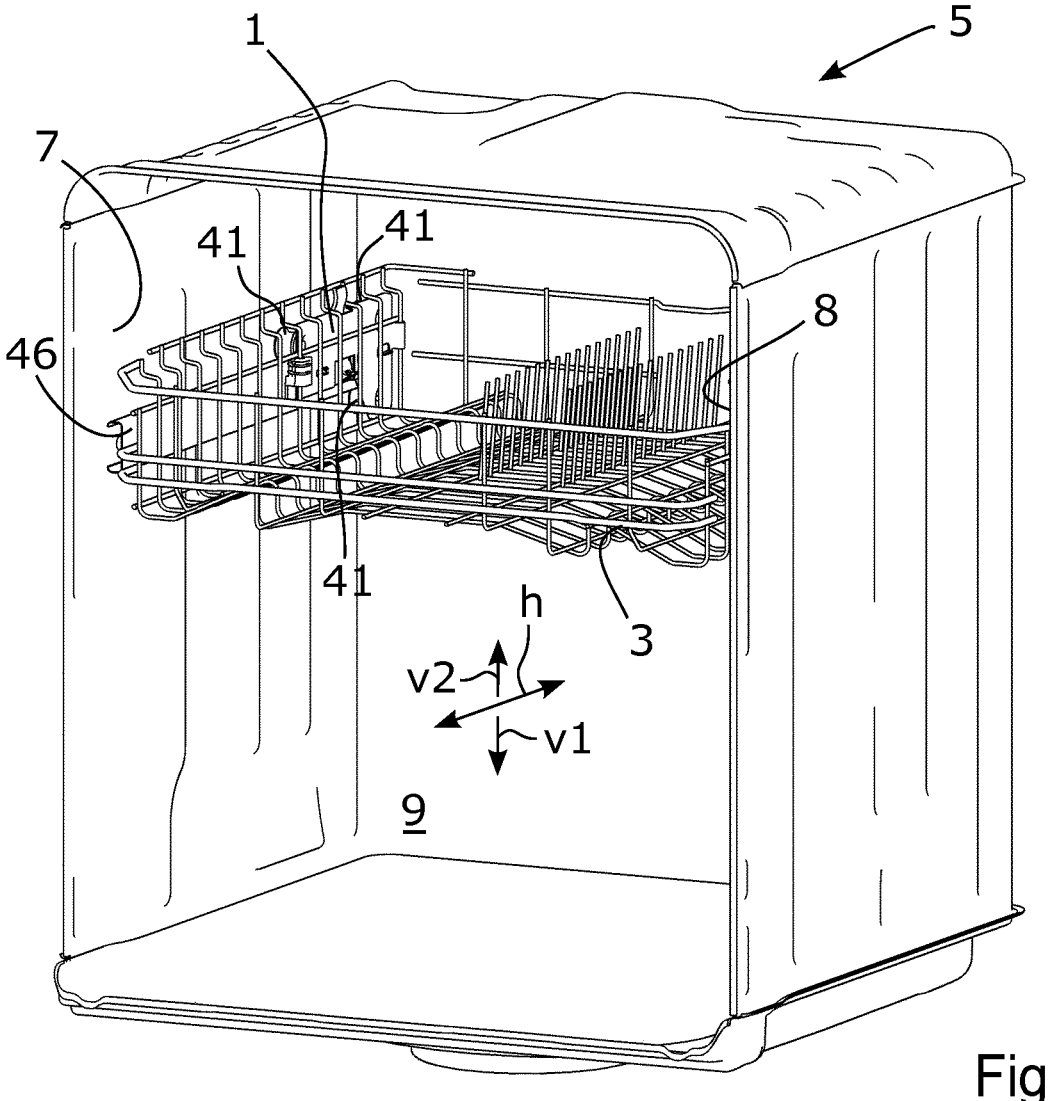
FIG. 1 illustrates a dishwasher comprising a washing chamber, a rack, and a bracket holding the rack against a wall of the washing chamber.
Figure 2:
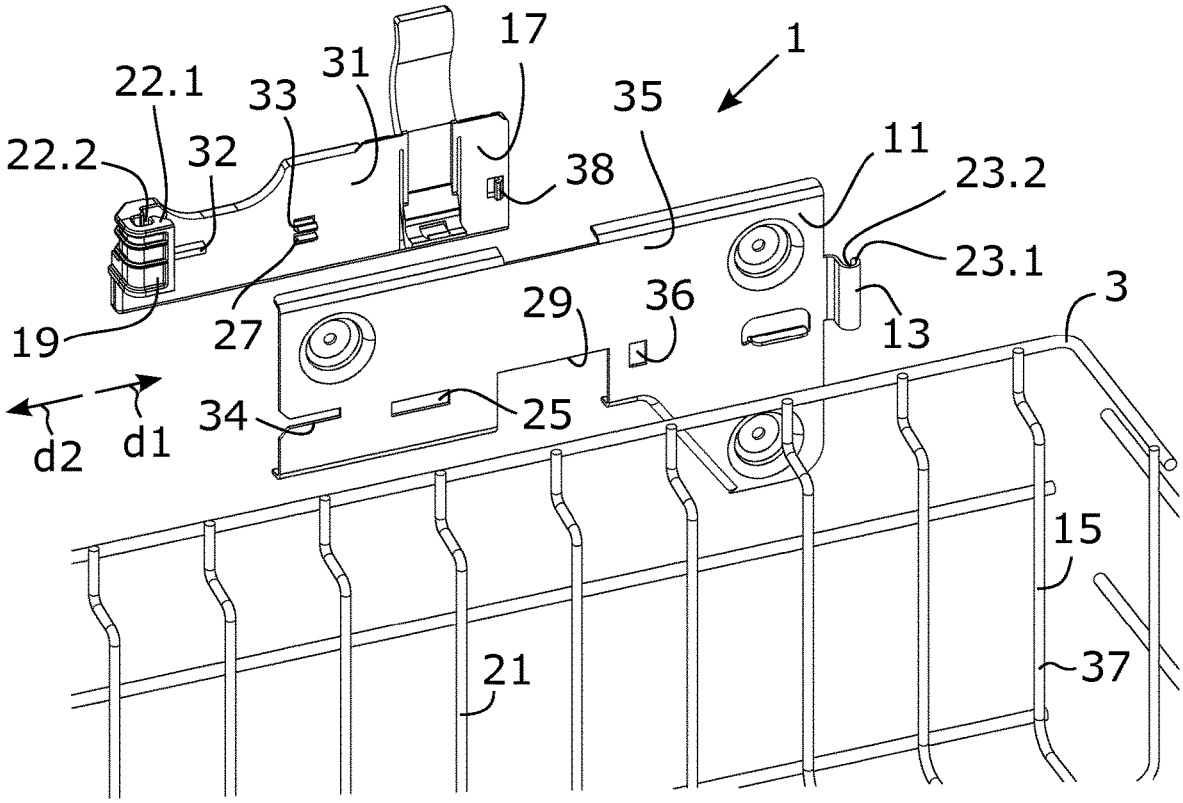
FIG. 2 illustrates an exploded view of the bracket illustrated in FIG. 1.

FIG. 1 illustrates a dishwasher 5 comprising a washing chamber 9 and a rack 3. The rack 3 is configured to accommodate items to be washed within the washing chamber 9. The dishwasher 5 further comprises a casing, one or more spray arrangements configured to spray washing liquid onto the items within the washing chamber 9 and a dishwasher door, wherein the dishwasher door is arranged to provide a closure of the washing chamber 9. These components are not illustrated for the reason of brevity and/or clarity. The dishwasher 5 further comprises a bracket 1 holding the rack 3 against a wall 7 of the washing chamber 9. FIG. 2 illustrates an exploded view of the bracket 1 illustrated in FIG. 1. The bracket 1 comprises a first bracket member 11 and a second bracket member 17. When the bracket 1 is assembled, the second bracket member 17 is slidably arranged to the first bracket member 11 along a first direction d1. The first bracket member 11 comprises a first fastening element 13 configured to fasten the first bracket member 11 to a first mounting portion 15 of the rack 3. According to the illustrated embodiments, first fastening element 13 comprises a hook 23.1 and the first mounting portion 15 is a portion of a vertically oriented wire 37 of the rack 3. Thereby, the first fastening element 13 can be fastened to the first mounting portion 15 in a simple manner. The second bracket member 17 comprises a second fastening element 19 configured to fasten the second bracket member 17 to a second mounting portion 21 of the rack 3 upon a sliding movement of the second bracket member 17 in the first direction d1.

Figure 3A:
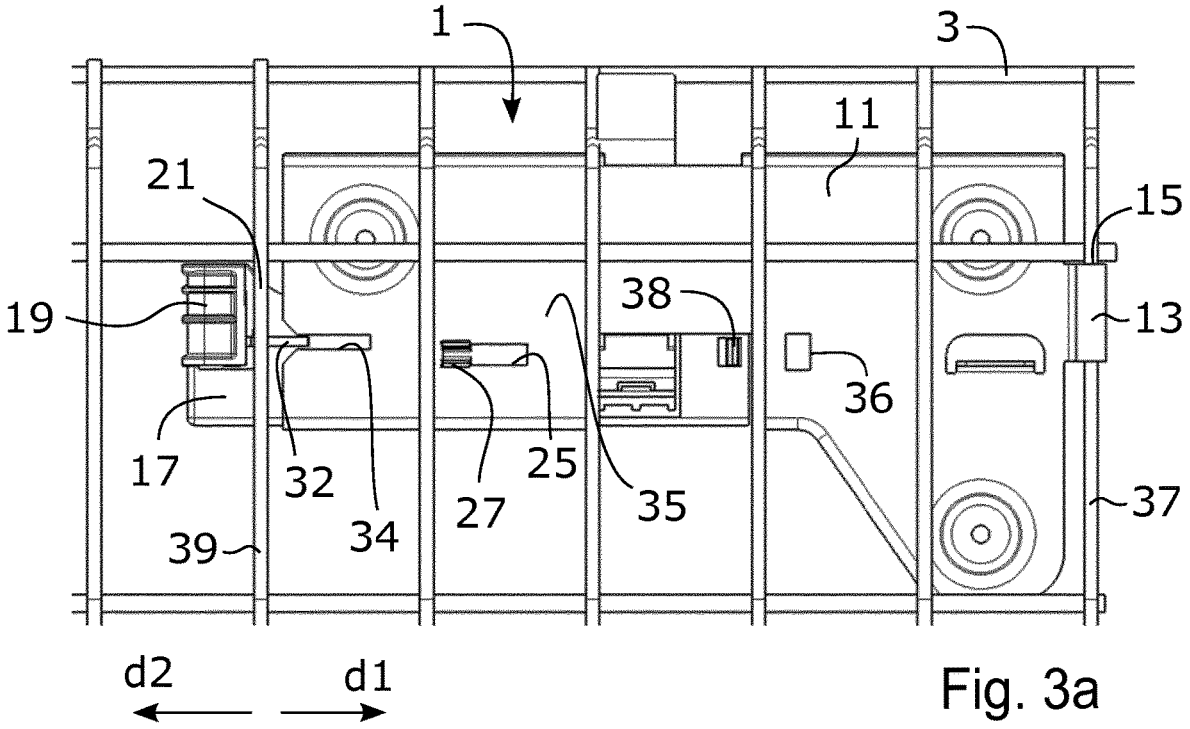
FIG. 3*a* illustrates the bracket illustrated in FIG. 1 and FIG. 2, where a first fastening element of the bracket has been fastened to a first mounting portion of the rack.

FIG. 3*a* illustrates the bracket 1 illustrated in FIG. 1 and FIG. 2, in an assembled state where the first fastening element 13 has been fastened to a first mounting portion 15 of the rack 3.

According to the illustrated embodiments, the first fastening element 13 and the first mounting portion 15 are arranged to allow pivotal movement of the bracket 1 relative the first mounting portion 15 when the first fastening element 13 is fastened to the first mounting portion 15. Thus, according to these embodiments, a user may fasten the first fastening element 13 to the first mounting portion 15 at a different rotational position of the bracket 1 relative the rack 3, than illustrated in FIG. 3*a*, such as a rotational position where the bracket 1 is pivoted out from the rack 3. Thereby, the fastening process is facilitated of the first fastening element 13 to the first mounting portion 15 of the rack 3, since a user may choose a convenient rotational position in the fastening process. After this, the user may pivot the bracket 1 relative the rack 3 into the position as is illustrated in 3*a*, i.e. a position in which the second fastening element 19 faces the second mounting portion 21. Then, the user may apply a force onto the second bracket member 17 in the first direction d1 to perform a sliding movement of the second bracket member 17 relative the first bracket member 11 in the first direction d1.

Figure 3B:
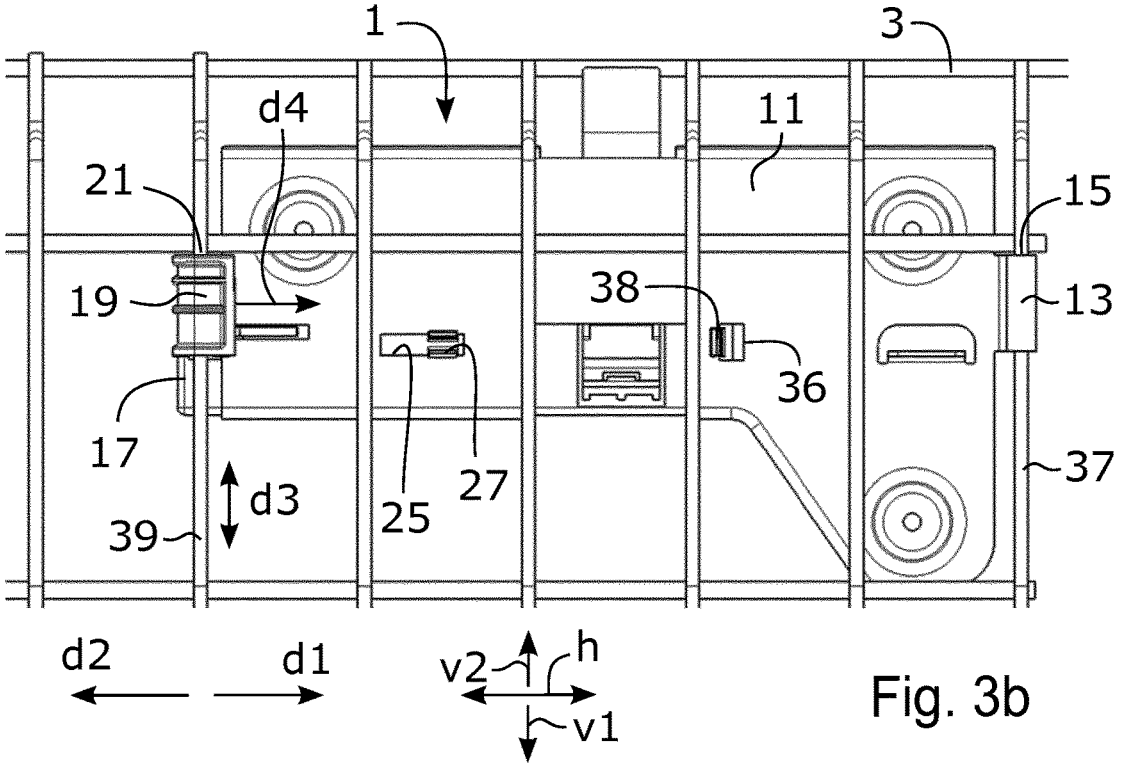
FIG. 3*b* illustrates the bracket illustrated in FIG. 3*a*, where a second fastening element of the bracket has been fastened to a second mounting portion of the rack.

FIG. 3*b* illustrates the bracket 1 illustrated in FIG. 3*a*, where the second fastening element 19 has been fastened to a second mounting portion 21 of the rack 3, as a result of a sliding movement of the second bracket member 17 relative the first bracket member 11, in the first direction d1, from the position as illustrated in FIG. 3*a*.

As can be seen in the FIGS. 3*a* and 3*b*, and as is indicated in FIG. 2, the second fastening element 19 comprises a hook 22.1 with an open portion 22.2 facing in the first direction d1.

Thereby, a simple and efficient fastening of the second fastening element 19 to the second mounting portion 21 is provided upon the sliding movement of the second bracket member 17 in the first direction d1. According to the illustrated embodiments, the hook 22.1 of the second fastening element 19 is flexible and is arranged to flex when the second fastening element 19 meets the second mounting portion 21 upon the sliding movement of the second bracket member 17 in the first direction d1. The second fastening element 19 may be arranged to assume, or almost assume, its original shape to provide a secure fastening the second fastening element 19 to the second mounting portion 21, when the second bracket member 17 has been fully displaced in the first direction d1, the hook 22.1 of. In this manner, the second fastening element 19 may hinder movement of the second fastening element 19, and thus also the second bracket member 17, relative the second mounting portion 21, in the first direction d1, as well as in a second direction d2 being opposite to the first direction d1, when the second fastening element 19 is fastened to the second mounting portion 21.

Further, as best seen in FIG. 2, also the first fastening element 13 comprises a hook 23.1 with an open portion 23.2. According to the illustrated embodiments, the open portion 23.2 of the hook 23.1 of the first fastening element 13 faces in a direction being substantially perpendicular to the first direction d1. Thus, according to these embodiments, the first fastening element 13 and the second fastening element 19 each comprises a hook 22.1, 23.1 with an open portion 22.2, 23.2 facing in a direction being substantially perpendicular to a facing direction of the open portion 22.2, 23.2 of the other fastening element. Thereby, attachment of the first fastening element 13 to the first mounting portion 15 is further ensured during the sliding movement of the second bracket member 17 relative the first bracket member 11 in the first direction d1. In addition, a rigid mounting of the bracket 1 onto the rack 3 is provided, being less sensitive to external forces, when both fastening elements 13, 19 are fastened to the rack 3.

According to the illustrated embodiments, and as is indicated in the FIGS. 3*a* and 3*b*, the first mounting portion 15 is a portion of an essentially vertical oriented wire 37 of the rack 3. Likewise, the second mounting portion 21 is a portion of an essentially vertical oriented wire 39 of the rack 3. Further, as is indicated in the FIG. 3*b*, according to these embodiments, the first direction d1 is essentially perpendicular to a direction d3 of extension of the wire 39. Thereby, the second fastening element 19 can be fastened to the second mounting portion 21 in a simple and efficient manner. In addition, as is indicated in the FIG. 3*b*, according to these embodiments, the first direction d1 coincides with a direction d4 pointing from the second fastening element 19 towards the first fastening element 13. Thus, according to these embodiments, the second fastening element 19 will move in a direction towards the first fastening element 13 upon the sliding movement of the second bracket member 17 in the first direction d1. According to the illustrated embodiments, the rack 3 is formed by a plurality of wires being welded to each other. The wires may comprise a metal material with a coated surface.

According to further embodiments, the first mounting portion may be a portion of an essentially horizontal oriented wire of the rack 3. Likewise, the second mounting portion may also be a portion of an essentially horizontal oriented wire of the rack 3. In such embodiments, the bracket 1 may comprise the corresponding features as indicated in the figures herein, but may be made shorter such that a shorter distance between the first and second fastening elements 13, 19 is obtained. According to still further embodiments, one of the first and second mounting portions 15, 21 comprises a portion of an essentially vertical oriented wire of the rack 3 and the other mounting portion of the first and second mounting portions 15, 21 comprises a portion of an essentially horizontal oriented wire of the rack 3. According to such embodiments, the bracket 1 may comprise the corresponding features as indicated in the figures herein, but one of the first and second fastening element 13, 19 may be provided with a hook having an open portion essentially facing in a direction essentially perpendicular to the facing directions of the hooks 22.1, 23.1 of the illustrated embodiments. For example, in such embodiments, the second fastening element 19 may comprise an open portion facing in a direction essentially coinciding with one of the directions d3 illustrated in FIG. 3*b*. Thus, in such embodiments, the first direction in which the second bracket member 17 is slidably arranged to the first bracket member 11 is substantially in the facing direction of the open portion of the second fastening element 19, i.e. in a direction essentially coinciding with one of the directions d3 illustrated in FIG. 3*b*.

According to still further embodiments, the rack 3 may comprise another material than a metallic material, such as a polymeric material, and may comprise another structure than a plurality of wires being welded to each other. For example, the rack may be formed by one coherent piece of polymeric material being provided with a plurality of openings to allow transfer of washing fluid therethrough. According to such embodiments, the rack may comprise first and second mounting portions 15, 21 in the form of designated portions of the rack configured to allow fastening of the respective first and second fastening elements 13, 19.

According to the illustrated embodiments, the bracket 1 comprises a guiding structure 25, 27 configured to prevent movement of the second bracket member 17 relative the first bracket member 11 in directions differing from the first direction d1 and a second direction d2, wherein the second direction d2 is opposite to the first direction d1. Thereby a rigid bracket 1 is provided and separation between the first and second bracket members 11, 17 is avoided when the bracket 1 is mounted onto the rack 3, as is illustrated in FIG. 3*b*, as well as prior to when the bracket 1 is mounted onto the rack 3. According to the illustrated embodiments, guiding structure 25, 27 is configured to prevent sliding movement of the second bracket member 17 in the second direction d2 past a predetermined position relative the first bracket member 11. In FIG. 3*a*, the second bracket member 17 is in the predetermined position relative the first bracket member 11.

According to the illustrated embodiments, the guiding structure 25, 27 comprises a slot 25 arranged in the first bracket member 11 and a guiding element 27 protruding into the slot 25, wherein the guiding element 27 is arranged at the second bracket member 17. Due to these features, the guiding element 27 will move along the slot 25 upon sliding movement of the second bracket member 17 relative the first bracket member 11 in the first and second directions d1, d2. Relative movement between the first and second bracket members 11, 17 will, as a result of the guiding structure 25, 27, be hindered in directions differing from the first and second directions d1, d2. In addition, according to the illustrated embodiments, relative movement between the first and second bracket members 11, 17 will be hindered when the guiding element 27 reaches an end portion of the slot 25. The slot 25 of the illustrated embodiments comprises two end portions. Thus, according to the illustrated embodiments, the guiding structure 25, 27 is configured to prevent sliding movement of the second bracket member 17 in the second direction d2 past a predetermined position relative the first bracket member 11, and configured to prevent sliding movement of the second bracket member 17 in the first direction d1 past a second predetermined position relative the first bracket member 11. According to further embodiments, the guiding structure 25, 27 may comprise a slot arranged at the second bracket member 17 and a guiding element protruding into the slot, wherein the guiding element is arranged at the first bracket member 11. The guiding structure according to such embodiments may function in the corresponding manner as in the embodiments described above.

As is indicated in FIG. 2, the first and second bracket members 11, 17 comprises a respective abutting surface 29, 31. When the bracket 1 is in an assembled state, as is illustrated in FIGS. 3*a* and 3*b*, the first and second bracket members 11, 17 abut against each other in the respective abutting surface 29, 31, wherein the guiding element 27 extends through the slot 25, and wherein the guiding element 27 comprises one or more guiding surfaces 33 abutting against a surface 35 being opposite to the abutting surface 29 of the bracket member 11 comprising the slot 25. Thereby, separation between the first and second bracket members 11, 17 is avoided in directions away from each other. In the illustrated embodiments, the guiding element 27 is arranged at the second bracket member 17. Thus, according to these embodiments, the guiding surfaces 33 of the guiding element 27 abut against a surface 35 of the first bracket member 11, being opposite to the abutting surface 29 of the first bracket member 11. According to further embodiments, it may be the other way around, i.e. the guiding element 27 may be arranged at the first bracket member 11 and extending through a slot of the second bracket member 17, wherein guiding surfaces of the guiding element abut against a surface of the second bracket member 17, being opposite to the abutting surface 31 of the second bracket member 17.

The bracket 1 may comprise further guiding structures being configured to prevent movement of the second bracket member 17 relative the first bracket member 11 in directions differing from the first direction d1 and the second direction d2. For example, the bracket 1 may, as indicated in FIG. 2 and FIG. 3*a*, comprise a second guiding element 32, arranged at one of the first and second bracket members 11, 17, and a second slot 34, arranged at the other bracket member of the first and second bracket members 11, 17, wherein the second guiding element 32 protrudes into the second slot 34 to prevent movement of the second bracket member 17 relative the first bracket member 11 in directions differing from the first direction d1 and the second direction d2. In embodiments comprising two guiding structures arranged at a distance from each other, as the illustrated embodiments, rotation of the second bracket member 17 relative the first bracket member 11 is further prevented in a simple and efficient manner.

According to the illustrated embodiments, and as indicated in FIG. 2, the first bracket member 11 may comprise a first locking member 36 and the second bracket member 17 may comprise a second locking member 38, wherein the first and second locking members 36, 38 are arranged to intermesh to lock sliding movement of the second bracket member 17 in the second direction d2 relative the first bracket member 11, when the second bracket member 17 has been fully displaced in the first direction d1, relative the first bracket member 11, to a position in which the second fastening element 19 is fasten to the second mounting portion 21 of the rack 3. Such a position of the second bracket member 17 is illustrated in FIG. 3*b*. According to the illustrated embodiments, in this position, the second locking member 38 extends through the first locking element 36 to lock sliding movement of the second bracket member 17 in the second direction d2.

According to the illustrated embodiments, the first and second fastening elements 13, 19 are configured to allow displacement of the bracket 1 relative the rack 3 in vertical directions v1, v2 thereof to provide at least two different vertical positions of the rack 3 within the washing chamber 9. In FIGS. 3*a* and 3*b*, as well as in FIG. 1, the rack 3 is in a lower position. Since the bracket 1 is configured to hold the rack 3 against the wall 7 of the washing chamber 9, the bracket 1 is in an upper vertical position relative the rack 3, as is illustrated in FIGS. 3*a* and 3*b*, when the rack 3 is in the lower vertical position within the washing chamber 9. As indicated in FIG. 1, the vertical directions v1, v2 of the washing chamber 9 comprise a first vertical direction v1 and a second vertical direction v2. The first vertical direction v1 of the washing chamber 9 is a direction coinciding with a direction of the gravitational field of the earth when the dishwasher 1 is positioned in an upright use-position. The second vertical direction v2 is opposite to the first vertical direction v1. Horizontal directions h of the washing chamber 9 are essentially perpendicular to the direction of the gravitational field when the dishwasher 1 is positioned in the upright use-position.

Figure 4:
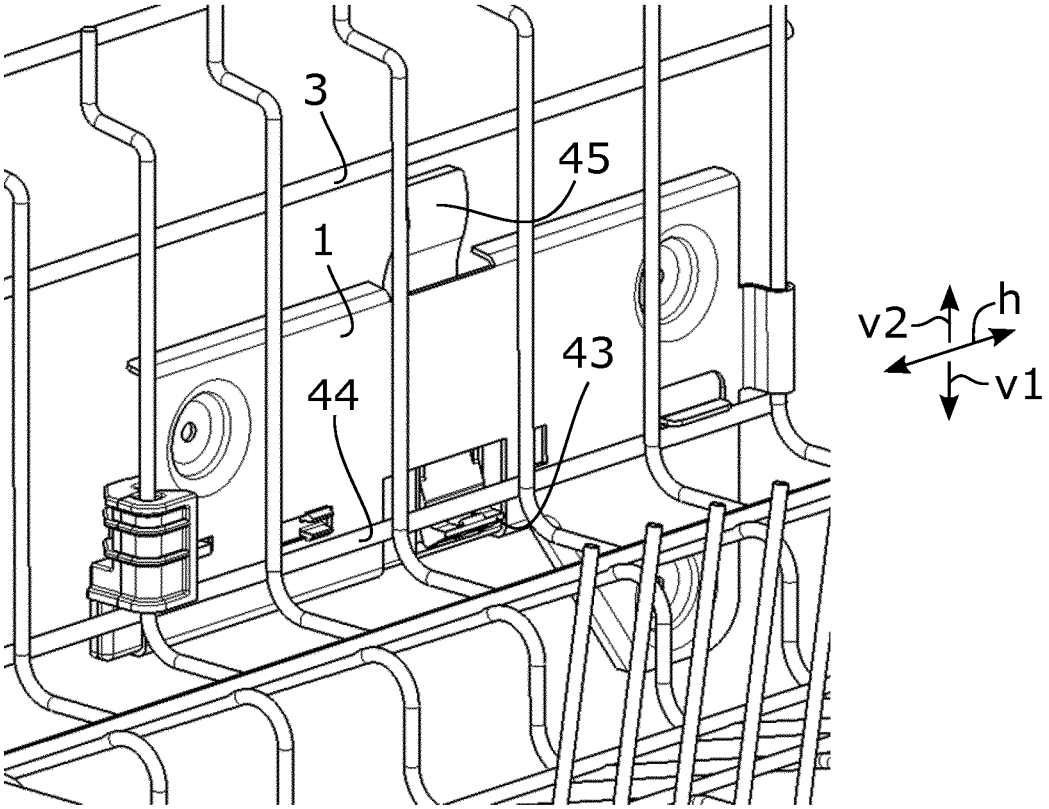
FIG. 4 illustrates the bracket illustrated in FIGS. 3*a* and 3*b* in an upper vertical position relative the rack.

FIG. 4 illustrates the bracket 1 illustrated in FIGS. 3*a* and 3*b* in an upper vertical position relative the rack 3, i.e. in a position occurring when the rack 3 is in an upper position within the washing chamber 9. According to the illustrated embodiments, the bracket 1 comprises a retaining element 43 configured to retain the rack 3 in the upper position. The bracket 1 further comprises a handle 45 being connected to the retaining element 43. By actuating the handle 45, the retaining element 43 can be displaced from a locking position, as is illustrated in FIG. 4, to an unlocking position in which the retaining element 43 is displaced to a position in which it is released from the essentially horizontally oriented wire 44, thereby allowing the rack 3 to be displaced from the upper position to the lower position. The retaining element 43 may be biased towards the locking position, for example by a spring (not illustrated). Upon displacement of the rack 3 to the upper position, the retaining element 43 may be configured to allow vertical movement of the essentially horizontally oriented wire past the retaining element 43, and the retaining element 43 may be configured to assume the locked position when the rack 3 reaches the upper position.

According to the embodiments of the bracket 1 illustrated in FIG. 1, the first bracket member 11 comprises wheels 41 configured to allow horizontal displacement of the rack 3 in relation to the wall 7 of the washing chamber 9. According to further embodiments, the second bracket member 17 comprises wheels 41 configured to allow horizontal displacement of the rack 3 in relation to the wall 7 of the washing chamber 9. According to still further embodiments, both the first bracket member 11 and the second bracket member 17 comprise one or more wheels 41 configured to allow horizontal displacement of the rack 3 in relation to the wall 7 of the washing chamber 9.

According to the embodiments of the bracket 1 illustrated in FIG. 1, rolling surfaces of the wheels 41 are arranged to abut against a rail 46 to allow horizontal displacement of the rack 3 in relation to the wall 7 of the washing chamber 9. Thus, as is illustrated in FIG. 1, the dishwasher comprises a rail 46 mounted onto a first inner side wall 7 of the washing chamber 9. The dishwasher 5 of FIG. 1 further comprises a second rail mounted onto a second inner side wall 8 of the washing chamber 9, wherein the second inner side wall 8 is opposite to the first inner side wall 7. The dishwasher 5 further comprises a second bracket holding the rack 3 against the second inner side wall 8 of the washing chamber 9. The second bracket and the second rail are not visible in FIG. 1 but are of similar, but mirrored, design as the bracket 1 and the rail 46 visible in FIG. 1.

According to the illustrated embodiments, the first bracket member 11 is formed by a metallic material and the second bracket member 17 is formed by a polymeric material. Further, according to the illustrated embodiments, the hook 23.1 of the first fastening element 13 is formed by bended portions of a flange of the first bracket member 11. Due to these features, the first fastening element 13 can be provided in a cost-efficient manner while it provides a secure fastening of the first bracket member 11 to the first mounting portion 15 of the rack 3. According to some embodiments, both the first bracket member 11 and the second bracket member 17 is formed by a polymeric material. Also, according to some embodiments, the first bracket member 11 may be formed by a polymeric material and the second bracket member 17 may be formed by a metallic material.

In an assembly process of the dishwasher 5 illustrated in FIG. 1, an assembler may fasten a first fastening element of the bracket 1 to a first mounting portion of the rack 3, and pivot the bracket 1 relative the rack into a position in which the second fastening element faces the second mounting portion. Then, the assembler may displace the second bracket member in the first direction to fasten the second fastening element to the second mounting portion, to thereby fasten the bracket 1 to the rack 3. After this, the assembler may perform a corresponding mounting procedure of a second bracket at an opposite side of the rack 3. Then, the assembler may take the rack, with the two brackets arranged thereto, and align the wheels 41 of the brackets to the rails 46 arranged at the opposite sides 7, 8 of the washing chamber 9 and slide the rack 3 into the washing chamber 9 into the position as is illustrated in FIG. 1. After this, the assembler may mount stopping elements at distal ends of the rails to prevent the rack from falling out of the washing chamber 9 when the rack 3 is fully displaced in a direction out of the washing chamber 9. Accordingly, due to the bracket 1 provided, conditions are provided for assembling components of a dishwasher 5 in a simple and cost efficient manner.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the present invention, as defined by the appended claims. For example, instead of the guiding element 27 and the slot 25, the guiding structure may comprise a recess, a slit, or similar, arranged at one of the first and second bracket members 11, 17, wherein a portion of the other bracket member is arranged to extend into the recess, slit, or similar, to prevent movement of the second bracket member 17 relative the first bracket member 11 in directions differing from the first direction d1 and the second direction d2.

As used herein, the term "comprising" or "comprises" is open-ended, and includes one or more stated features, elements, steps, components or functions but does not preclude the presence or addition of one or more other features, elements, steps, components, functions or groups thereof. The bracket 1 may for instance comprise more than one first fastening element 13, such as two, or more, first fastening elements 13 arranged at a distance from each other at the first bracket portion 11. Further, the bracket 1 may comprise more than one second fastening element 19, such as two, or more, second fastening elements 19 arranged at a distance from each other at the second bracket portion 17.

The invention claimed is:

1. A bracket configured to hold a rack of a dishwasher against a wall of a washing chamber of the dishwasher, wherein the bracket comprises a first bracket member comprising a first fastening element configured to fasten the first bracket member to a first mounting portion of the rack, wherein the bracket comprises a second bracket member slidably arranged to the first bracket member along a first direction (d1), wherein the second bracket member comprises a second fastening element configured to fasten the second bracket member to a second mounting portion of the rack upon a sliding movement of the second bracket member in the first direction (d1) wherein the bracket comprises a guiding structure configured to prevent movement of the second bracket member relative to the first bracket member in directions differing from the first direction (d1) and a second direction (d2), wherein the second direction is opposite to the first direction (d1).

2. The bracket according to claim 1, wherein the second fastening element comprises a hook with an open portion facing in the first direction (d1).

3. The bracket according to claim 1, wherein the guiding structure is further configured to prevent sliding movement of the second bracket member in the second direction (d2) past a predetermined position relative to the first bracket member.

4. The bracket according to claim 1, wherein the guiding structure comprises a slot arranged in one bracket member of the first and second bracket members, and a guiding element protruding into the slot, wherein the guiding element is arranged at the other bracket member of the first and second bracket members.

5. The bracket according to claim 4, wherein the first and second bracket members abut against each other in a respective abutting surface, wherein the guiding element extends through the slot, and wherein the guiding element comprises one or more guiding surfaces abutting against a surface being opposite to the abutting surface of the bracket member comprising the slot.

6. The bracket according to claim 1, wherein at least one bracket member of the first and second bracket members comprises wheels configured to allow horizontal displacement of the rack in relation to the wall of the washing chamber.

7. A rack comprising a bracket according to claim 1.

8. The rack according to claim 7, wherein the first mounting portion is a portion of a wire of the rack.

9. The rack according to claim 7, wherein the second mounting portion is a portion of a wire of the rack.

10. The rack according to claim 9, wherein the first direction (d1) is essentially perpendicular to a direction (d3) of extension of the wire.

11. The rack according to claim 7, wherein the first fastening element and the first mounting portion are arranged to allow pivotal movement of the bracket relative to the first mounting portion when the second fastening element is released from the second mounting portion.

12. The rack according to claim 7, wherein the first and second fastening elements are configured to allow displacement of the bracket relative the rack in vertical directions (v1, v2) thereof to provide at least two different vertical positions of the rack within the washing chamber.

13. The rack according to claim 7, wherein the at least two different vertical positions comprise an upper position and a lower position, wherein the bracket comprises a retaining element configured to retain the rack in the upper position upon displacement of the rack to the upper position.

14. A dishwasher comprising a rack according to claim 7.

* * * * *